US006666288B2

(12) United States Patent
Kruse et al.

(10) Patent No.: US 6,666,288 B2
(45) Date of Patent: Dec. 23, 2003

(54) COATED CUTTING TOOL INSERT WITH IRON-NICKEL BASED BINDER PHASE

(75) Inventors: Olof Kruse, Fagersta (SE); Anna Sandberg, Fagersta (SE); Benno Gries, Wolfenbüttel (DE)

(73) Assignees: Seco Tools AB, Fagersta (SE); H.C. Starck GmbH & Co. KG, Goslar (DE)

( * ) Notice: Subject to any disclaimer, the term of this patent is extended or adjusted under 35 U.S.C. 154(b) by 0 days.

(21) Appl. No.: 09/988,646

(22) Filed: Nov. 20, 2001

(65) Prior Publication Data

US 2002/0112896 A1 Aug. 22, 2002

(30) Foreign Application Priority Data

Dec. 22, 2000 (SE) ..... 0004817
May 4, 2001 (SE) ..... 0101561

(51) Int. Cl.[7] ..... E21B 10/52
(52) U.S. Cl. ..... 175/426; 75/240
(58) Field of Search ..... 175/426, 428, 175/435; 75/240, 10, 19

(56) References Cited

U.S. PATENT DOCUMENTS 4,339,272 A * 7/1982 Grover et al. ..... 75/240
4,531,595 A 7/1985 Housman
4,597,456 A * 7/1986 Ecer ..... 175/426
4,608,318 A * 8/1986 Makrides et al. ..... 75/240
5,305,840 A * 4/1994 Liang et al. ..... 175/426
5,773,735 A 6/1998 Dubensky et al.
6,024,776 A 2/2000 Heinrich et al.
6,214,247 B1 * 4/2001 Leverenz et al. ..... 75/10.19

FOREIGN PATENT DOCUMENTS

| | | |
|---|---|---|
| DE | 296 17 040 U1 | 3/1997 |
| EP | 0 085 125 | 8/1983 |
| EP | 1 024 207 A1 | 8/2000 |
| JP | 61-261454 | 11/1986 |
| JP | 2-15159 | 1/1990 |
| JP | 8-225878 | 9/1996 |
| WO | 99/59755 | 11/1999 |

* cited by examiner

*Primary Examiner*—David Bagnell
*Assistant Examiner*—Matthew J Smith
(74) *Attorney, Agent, or Firm*—Burns, Doane, Swecker & Mathis, L.L.P.

(57) ABSTRACT

The present invention relates to cutting tool insert consisting of a tungsten carbide based hard metal substrate and a coating. The hard metal consists of about 4-15 wt-% binder phase with face centered cubic structure and a composition of 35–65 wt-% Fe and 35–65 wt-% Ni in addition to dissolved elements. As a result, inserts have been produced with at least as good performance in machining as conventional state-of-the-art inserts with Co-based binder phase. The insert can be applied in milling and turning of low and medium alloyed steels as well as stainless steels.

7 Claims, 1 Drawing Sheet

COATED CUTTING TOOL INSERT WITH IRON-NICKEL BASED BINDER PHASE

FIELD OF THE INVENTION

Figure 1A:
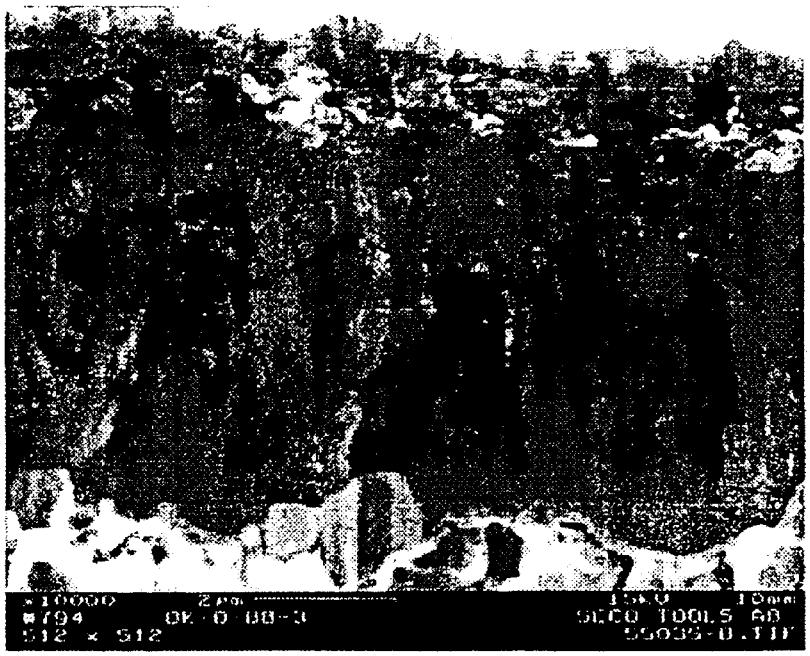

The present invention relates to cutting tool insert consisting of a tungsten carbide based hard metal substrate and a coating. The hard metal has an iron-nickel binder phase exhibiting a face centered cubic (fcc) structure. As a result, a coated hard metal insert with no cobalt and at least as good performance in machining as a corresponding coated hard metal insert with Co-based binder has been obtained. The insert is useful in milling and turning of low and medium alloyed steels as well as stainless steels.

BACKGROUND OF THE INVENTION

In the description of the background of the present invention that follows reference is made to certain structures and methods, however, such references should not necessarily be construed as an admission that these structures and methods qualify as prior art under the applicable statutory provisions. Applicants reserve the right to demonstrate that any of the referenced subject matter does not constitute prior art with regard to the present invention.

Hard metals are composite materials comprising grains of a hard phase and a binder phase that binds the hard phase grains. An example of a hard metal is tungsten carbide (WC) and cobalt (Co), also known as cobalt cemented tungsten carbide or WC—Co. Here, the hard component is WC while the binder phase is cobalt based, for example, a cobalt-tungsten-carbon alloy. The Co content is generally 6–20 wt-%. The binder phase is mainly composed of cobalt in addition to dissolved W and C.

Cobalt is, thus, the major binder in hard metals. For example, about 15 percent of the world's annual primary cobalt output is used in the manufacture of hard materials including WC-based cemented carbides. About 25 percent of the world's annual primary cobalt output is used in the manufacture of superalloys developed for advanced aircraft turbine engines—a factor contributing to cobalt being designated a strategic material. About half of the world's primary cobalt supply is obtained in politically unstable regions. These factors not only contribute to the high cost of cobalt but also explain its erratic cost fluctuations.

Industrial handling of hard metal raw materials may cause lung disease on inhalation. A study by Moulin et al. (1998) indicates that there exists a relationship between lung cancer and exposure to inhaled particles containing WC and Co.

Therefore, it would be desirable to reduce the amount of cobalt used as binder in hard metals.

Attempts have been made to achieve this goal in hard metals by substituting the Co-based binder phase with an iron rich iron-cobalt-nickel binder phase (Fe—Co—Ni-binder). Hard metals with an iron rich Fe—Co—Ni—binder have thus been strengthened by stabilizing a body centered cubic (bcc) structure in the Fe—Co—Ni—binder. This bcc structure was achieved by a martensitic transformation. Hard metal with enhanced corrosion resistance has been obtained with a nickel rich nickel-iron binder at high binder contents.

EP-A-1024207 relates to a sintered cemented carbide consisting of 50 to 90 wt-% submicron WC in a hardenable binder phase. The binder phase consists of, in addition to Fe, 10–60 wt-% Co, <10 wt-% Ni, 0.2–0.8 wt-% C and Cr and W and possibly Mo and/or V.

JP 2-15159 A relates to a substrate consisting of a hard phase with composition (Ti,M)CN, where M is one or more of Ta, Nb, W, and Mo. In addition, there is a binder phase selected from the group Co, Ni, and Fe. The substrate is coated with a Ti-based hard coating.

U.S. Pat. No. 4,531,595 discloses an insert for earth boring tools, such as drill bits, with diamonds imbedded in a sintered matrix of WC and a Ni—Fe binder. The matrix prior to sintering has a particle size of from about 0.5 to about 10 $\mu$m. The Ni—Fe binder represents from about 3% to about 20% by weight of the matrix.

U.S. Pat. No. 5,773,735 discloses a cemented tungsten carbide body with a binder phase selected from the group Fe, Ni, and Co. The average WC grain size is at most 0.5 $\mu$m and the material is free of grain growth inhibitors.

In U.S. Pat. No. 6,024,776 cemented carbides having a Co—Ni—Fe—binder are described. The Co—Ni—Fe—binder is unique in that even when subjected to plastic deformation, the binder substantially maintains its face centered cubic crystal structure and avoids stress and/or strain induced phase transformations.

WO 99/59755 relates to a method for producing metal and alloy powders containing at least one of the metals iron, copper, tin, cobalt, or nickel. According to the method an aqueous solution of metal salts is mixed with an aqueous carboxylic acid solution. The precipitate is then separated from the mother liquor and thereafter reduced to metal.

SUMMARY OF THE INVENTION

A cutting tool insert has a tungsten carbide based hard metal substrate and a coating. The hard metal has 4–15 wt. % of a binder phase having a face centered cubic structure. In one embodiment, the binder phase has 35–65 wt. % Fe, minor amounts of W, C, Cr, V, Zr, Hf, Ti, Ta, or Nb, and the balance Ni. In an additional embodiment, the binder phase has 40–60 wt. % Fe, minor amounts of W, C, Cr, V, Zr, Hf, Ti, Ta, or Nb, and the balance Ni. The coating has an inner layer of about 2–4 $\mu$m Ti(C,N) and a multilayer of about 2–4 $\mu$tm $Al_2O_3$ and TiN, the multilayer following the inner layer.

BRIEF DESCRIPTION OF THE DRAWING FIGURES

Figure 1B:
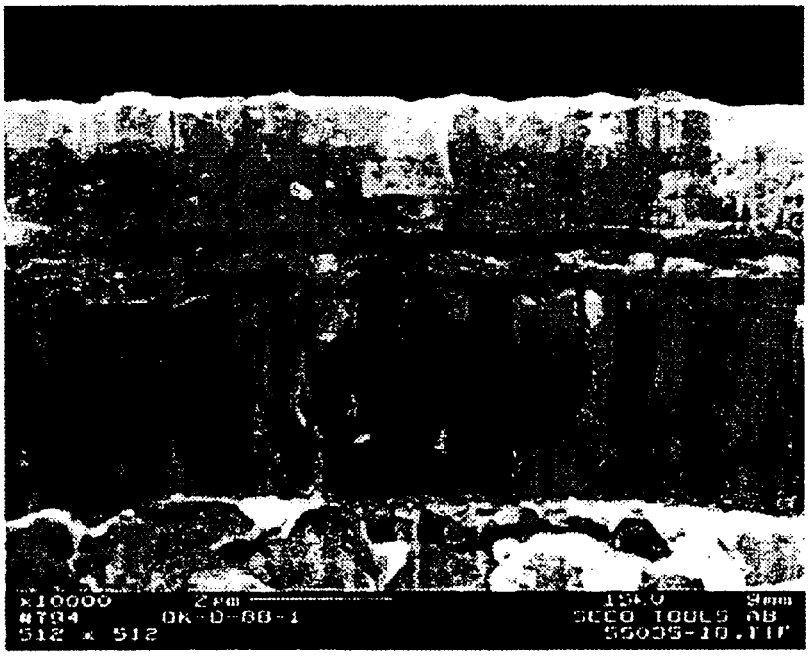

The objects and advantages of the invention will become apparent from the following detailed description of preferred embodiments thereof in connection with the accompanying drawings in which like numerals designate like elements and in which:

FIGS. 1*a–b* show scanning electron images of (a) a coating on a hard metal according to the invention and (b) a corresponding coating grown on a tungsten carbide based hard metal with Co binder. Scale bars are given on the photos.

DETAILED DESCRIPTION OF THE INVENTION

It has now surprisingly been found that inserts consisting of a tungsten carbide based hard metal with iron-nickel binder and a coating exhibits at least as good performance in machining as state-of-the-art commercial grade inserts consisting of conventional hard metal with cobalt binder and a coating.

The invention relates to a coated cutting tool insert consisting of a tungsten carbide based hard metal substrate and a coating. For use in milling applications, the hard metal contains 5–15 wt-% Fe and Ni forming the binder phase, preferably 6–13 wt-%, most preferably 7–12 wt-%. For use in turning applications, the hard metal contains 4–12 wt-% Fe and Ni forming the binder phase, preferably 4.5–11 wt-%, most preferably 5–10 wt-%. More particularly, the binder phase consists of an alloy which has a composition of 35–65 wt-% Fe and 35–65 wt-% Ni, preferably 40–60 wt-% Fe and 40–60 wt-% Ni, most preferably 42–58 wt-% Fe and 42–58 wt-% Ni. In the sintered material, the binder phase also contains minor amounts of W, C, and other elements, such as Cr, V, Zr, Hf, Ti, Ta, or Nb as a result of dissolution into the binder phase of these elements from the included carbide constituents during the sintering process. In addition, trace amounts of other elements may occur as impurities. The binder phase exhibits a face centered cubic structure.

The tungsten carbide grains have a mean intercept length of about 0.4–1.0 $\mu$m, preferably 0.5–0.9 $\mu$m. These values are measured on ground and polished representative cross sections through sintered material.

In addition to tungsten carbide, other compounds may also be included as hard phases in the sintered material. In one preferred embodiment, cubic carbide with composition (Ti,Ta,Nb,W)C is used. In another preferred embodiment, Zr and/or Hf may also be included in the cubic carbide. In the most preferred embodiment, (Ta,Nb,W)C is used. The cubic carbide is present in 0.1–8.5 wt-%, preferably 0.5–7.0 wt-%, most preferably 1.0–5.0 wt-%.

In addition to hard phases like tungsten carbide and cubic carbide, minor amounts (less than 1 wt-%) of chromium carbide and/or vanadium carbide may be included as grain growth inhibitor.

The total carbon concentration in a hard metal according to the invention is chosen so that free carbon or eta phase is avoided.

The coating consists of single or multiple layers known in the art. In one preferred embodiment, the coating consists of an inner layer of about 2–4 $\mu$m Ti(C,N) followed by a multilayer coating of about 2–4 $\mu$m $Al_2O_3$ and TiN. In another preferred embodiment, the coating consists of an inner layer of at least about 2.5 $\mu$m Ti(C,N) followed by a layer of about 0.5–1.5 $\mu$m $Al_2O_3$ with a total coating thickness of about 3.5–6.5 $\mu$m. In a third preferred embodiment, the coating consists of an inner layer of about 3–5 $\mu$m Ti(C,N) followed by about 2–4 $\mu$m $Al_2O_3$. In a fourth preferred embodiment the coating consists of about 5–8 $\mu$m Ti(C,N) followed by about 4–7 $\mu$m $Al_2O_3$. In yet another preferred embodiment the coating consists of about 1–3 $\mu$m TiN.

In the preferred embodiments where Ti(C,N) forms the inner layer of the coating, the Ti(C,N) crystals exhibit radial growth (see FIG. 1*a*) whereas Ti(C,N) grown on a conventional hard metal with Co binder exhibits a columnar pattern (see FIG. 1*b*).

The substrate is made by conventional powder metallurgical technique. Powder constituents forming the binder phase and hard phases are mixed by milling and thereafter granulated. The granulate is then pressed to green bodies of desired shape and dimension which thereafter are sintered. The powder forming the binder phase is added as a prealloy. The sintered substrates are subsequently coated with one or more layers using known CVD, MTCVD, or PVD methods, or combinations of CVD and MTCVD methods.

EXAMPLE 1

273 g of a tungsten carbide powder with grain size 0.8 $\mu$m FSSS (according to ASTM B330), doped with 0.15 wt-% vanadium carbide, were milled together with 27 g of a FeNi alloy powder (prepared according to WO 99/59755 with 48.5 wt-% Fe, 50.54 wt-% Ni, and 0.43 wt-% oxygen, with grain size 1.86 $\mu$m FSSS according to ASTM B330) and 0.3 g carbon black for 3 h in a 500 ml attritor mill, using hexane as milling liquid. After 3 h, the balls (3 mm diameter, 2.1 kg) were separated by screening. Hexane was then separated by vacuum distillation. The resulting powder was pressed at 1500 kp/cm$^2$ and sintered under vacuum at 1450° C. for 45 min. The resulting hard metal had the following properties:

| | |
|---|---|
| Coercitive force | 17.1 kA/m |
| Density | 14.57 g/cm$^3$ |
| Magnetic saturation | 136 Gcm$^3$/g |
| Hardness Rockwell A | 92.6 |
| Hardness Vickers (30 kg) | 1698 kg/mm$^2$ |
| Porosity (ISO 4505) | A06 B00 C00 |

EXAMPLE 2

Inserts according to the invention were tested for room temperature coating adhesion against a commercial coated cemented carbide grade: Seco T250M, with a substrate consisting of WC, 10.2 wt-% Co, and 1.5 wt-% Ta+Nb (in cubic carbide). The T250M substrate material was obtained by pressing powder intended for the standard production of this grade. The powder contained PEG (polyethylene glycol) as pressing aid. Pressing was made uniaxially at 1750 kp/cm$^2$. Sintering was made in a lab size sinterHIP unit with a maximum temperature of 1430° C. at 30 bar Ar pressure during 30 minutes. Coating was made with CVD. The coating consisted of a 2–4 $\mu$m inner layer of Ti(C,N) and a 2–4 $\mu$m multilayer of $Al_2O_3$ and TiN.

Inserts according to the invention had the same composition and coating with the exception that the Co binder phase was replaced by the same volume of a Fe+Ni 50/50 (by weight) alloy. The desired composition was obtained by mixing powders as follows: 3550 g WC with a grain size (Fisher, milled according to ASTM) of 2.3+0.3 $\mu$m, 383 g Fe—Ni as mentioned above, 64.44 g TaC/NbC (carbide weight ratio 90/10) and 2.26 g carbon black. As pressing aid, 80 g PEG 3400 was added. Milling was made in a lab-size ball mill with 12 kg cemented carbide balls with maximum 8.5 mm diameter and 800 cm$^3$ liquid obtained by diluting 7 dm$^3$ ethanol to 8 dm$^3$ with deionized water. The mill rotated with 44 rev/min for 60 h. The slurry thus obtained was spray dried into a granulate. Pressing, sintering, and coating was made as for the commercial grade inserts.

The insert geometry was SNUN120412.

Testing was made with a standard laboratory equipment (Revetest). In this test, a diamond indenter is pressed perpendicularly into the insert rake face with a defined force. The insert is then moved 6 mm at a defined velocity parallel with the rake face. Thus, a scratch mark is formed by the indenter. These marks are then inspected in a stereo lens in order to reveal whether they are restricted to the coating or penetrate into the substrate. If a large force is needed to totally remove the coating, then its adhesion to the substrate is good.

Testing was made with three commercial grade inserts and three inserts according to the invention. The indenter force was 60 and 70 newton. The commercial grade insert showed coating loss after 1.2 mm scratch length at 60 N, 0.3 mm at 70 N, and 0.6 mm at 60 N. The insert according to the invention showed coating loss at 70 N (whole length), after 1.5 mm at 60 N, and 2.3 mm at 60 N.

EXAMPLE 3

Inserts according to the invention were tested for machining performance in turning. The work piece material was an SS1672 (corresponds to W-nr 1.1191, DIN Ck45, or AISI/SAE 1045) cylindrical bar. Cutting speed was 250 m/min, feed 0.4 mm/rev and depth of cut 2.5 mm. The tool cutting edge angle was 75° and no coolant was applied. As reference grade, Seco T250M as described above was used. Reference grade inserts and inserts according to the invention were obtained as described under Example 1 above.

The insert geometry was SNUN120412 with an edge hone of about 35–40 $\mu$m.

Four edges each of inserts according to the invention and reference grade inserts were tested. Of these four edges, two were run four minutes and two were run six minutes.

Reference grade edges run four minutes showed flank wear values of 0.08 and 0.06 mm. Corresponding values for inserts according to the invention were 0.07 and 0.06 mm. All edges run six minutes showed flank wear values of 0.07 mm. Loss of coating occurred only in immediate conjunction with plastic deformation close to the edges.

EXAMPLE 4

Inserts according to the invention were tested in turning against the commercial grade Seco TP400 which has substrate and coating identical to T250M as described above. Reference grade inserts were ready-made products intended for sale. Inserts according to the invention were pressed, sintered, and coated following the procedure described under Example 1 above.

Insert geometry was CNMG120408 and tool cutting edge angle 95°.

Turning was made in a cylindrical bar of SS2343 (corresponds to W-nr 1.4436, DIN X5 CrNiMo 17 13 3, or AISI/SAE 316) at a cutting speed of 180 m/min, feed 0.3 mm/rev and depth of cut 1.5 mm. No coolant was applied. Machining was made in cycles with 15 s cutting followed by 15 s rest in order to cause temperature variations in the cutting tool. Three cutting edges each of inserts according to the invention and reference grade inserts were tested. The two sets of inserts were tested in pairs with total testing times (cutting+cooling) of 10, 12, and 14 min, respectively.

The resulting wear was dominated by chipping along the edge line and notch wear. Within all three pairs of inserts, the overall wear was about equal on comparison.

EXAMPLE 5

Inserts according to the invention, with 6.0 wt-% Fe and Ni in 50/50 weight proportion forming the binder phase, were tested in turning against the commercial grade Seco TX150. This grade has 6.0 wt-% Co in the substrate and a coating consisting of an inner layer of at least 5 $\mu$m Ti(C,N) followed by 1.0–2.5 $\mu$m $Al_2O_3$ with a total thickness of 9–14 $\mu$m. Reference inserts were ready-made products intended for sale. Inserts according to the invention were made following the procedure described under Example 1 above by mixing and granulating powder with appropriate proportions of constituents, followed by pressing, sintering, and coating.

Insert geometry was CNMA120408 and tool cutting edge angle 95°.

Turning was made in a cylindrical bar of SS0727 (corresponds to DIN GGG 50 or AISI/SAE 80-55-06) at a cutting speed of 140 m/min, feed 0.4 mm/rev and depth of cut 2.0 mm. No coolant was applied. The two varieties of inserts were tested in pairs with 5 minutes each of machining between measurements of wear.

The dominant wear mode was flank wear. Three edges per variety were tested until a flank wear of 0.3 mm was obtained. Reference grade inserts reached this wear after (interpolated values) 16.6, 17.5, and 17.9 minutes. Corresponding values for inserts according to the invention were 17.3, 16.9, and 18.3 minutes.

EXAMPLE 6

Inserts according to the invention were tested in milling against Seco T250M as described above. Reference grade inserts and inserts according to the invention were obtained as described under Example 1 above.

The insert geometry was SNUN120412 with an edge hone of about 35–40 $\mu$m.

The inserts were tested in a face milling operation in SS2244 (corresponds to W-nr 1.7225, DIN 42CrMo4, or AISI/SAE 4140) with a feed of 0.2 mm/tooth and depth of cut 2.5 mm. The cutter body used was a Seco 220.74-0125. The cutting speed was 200 m/min with coolant and 300 m/min without coolant. At each cutting speed, three edges per variety were used. The length of cut for each edge was 2400 mm.

The measured flank wear amounted to about 0.1 mm for both varieties at 200 and 300 m/min cutting speed.

At 200 m/min cutting speed with coolant, the commercial grade inserts showed 2 to 3 comb cracks across the edge lines whereas the test grade showed 0 to 1. At 300 m/min cutting speed without coolant, the commercial grade inserts showed 4 to 5 comb cracks whereas the test grade showed 2 to 3.

At 200 m/min cutting speed and coolant, no crater wear could be detected on any insert. At 300 m/min cutting speed without coolant, the crater wear on the commercial grade inserts could be inscribed within surface areas of 1.9×0.2 mm, 2.2×0.3 mm, and 2.5×0.3 mm, respectively. Corresponding values for inserts made according to the invention were 1.9×0.1, 1.7×0.1, and 2.2×0.3 mm, respectively.

The above examples show that a coated cutting tool insert can be manufactured from tungsten carbide based hard metal with an iron-nickel based binder. The performance of such an insert is at least as good as a corresponding state-of-the-art commercial grade insert with Co-based binder.

While the present invention has been described by reference to the above-mentioned embodiments, certain modifications and variations will be evident to those of ordinary skill in the art. Therefore, the present invention is limited only by the scope and spirit of the appended claims.

What is claimed is:

1. A cutting tool insert, comprising:

a tungsten carbide based hard metal substrate; and a coating, wherein the hard metal substrate has a binder phase comprising 40–60 wt. % Fe, minor amounts of W, C, Cr, V, Zr, Hf, Ti, Ta, or Nb, and the balance Ni.

2. The cutting tool insert of claim 1, wherein the binder phase has a face centered cubic structure.

3. The cutting tool insert of claim 1, wherein the hard metal substrate has 4–15 wt. % binder phase.

4. The cutting tool insert of claim 1, wherein the coating comprises an inner layer of about 2–4 $\mu$m Ti(C, N) and a multilayer of about 2–4 $\mu$m $Al_2O_3$ and TiN, the multilayer following the inner layer.

5. The cutting tool insert of claim 1, wherein the hard metal substrate has a total carbon concentration such that the hard metal substrate is eta-phase free or free-carbon free.

6. A cutting tool insert, comprising:

a tungsten carbide based hard metal substrate, the hard metal substrate having 4–15 wt. % of a binder phase comprising 35–65 wt. % Fe, and at least one additional element comprising: W, C, Cr, V, Zr, Hf, Ti, Ta, or Nb, and the balance Ni; and a coating.

7. The cutting tool insert of claim 6, wherein the at least one additional element is present in the binder phase as a result of dissolution of a carbide constituent during sintering.

* * * * *